United States Patent [19]

Knauff

[11] 4,238,755

[45] Dec. 9, 1980

[54] SIMPLIFIED LINEAR POTENTIOMETER

[76] Inventor: Robert J. Knauff, 819 N. Gardner St., West Hollywood, Calif. 90046

[21] Appl. No.: 969,251

[22] Filed: Dec. 13, 1978

[51] Int. Cl.[3] ..... H01C 10/38

[52] U.S. Cl. ..... 338/176; 338/184; 338/199; 338/202; 338/311

[58] Field of Search ..... 338/176, 194, 192, 202, 338/184, 196–197, 311–313; 46/1 R

[56] References Cited

U.S. PATENT DOCUMENTS

| | | | |
|---|---|---|---|
| 2,799,757 | 7/1957 | Bourns et al. | 338/202 X |
| 2,857,497 | 10/1958 | Bourns et al. | 338/202 X |
| 3,509,509 | 4/1970 | Rapisardi | 338/194 X |

*Primary Examiner*—C. L. Albritton

*Attorney, Agent, or Firm*—William H. Maxwell; Willis E. Higgins

[57] ABSTRACT

This potentiometer has a pair of insulating standoffs integrally formed with the body of a model or toy incorporating the potentiometer. An insulated trough extends between the standoffs. A resistive element wound around an insulating core is disposed in the trough. A resilient contact element is slidably mounted engagement with the resistive element. Means extends through the body of the model or toy for sliding the resilient contact element along the resistive element. This potentiometer has major portions of its assembly formed in a molding operation used to form the body of the model or toy, and can be assembled by hand without the use of special tools.

7 Claims, 2 Drawing Figures

SIMPLIFIED LINEAR POTENTIOMETER

BACKGROUND OF THE INVENTION

1. Field of the Invention

This invention relates to a linear potentiometer of simplified construction adapted for use in a model or toy. More particularly, it relates to such a potentiometer in which at least major portions of the potentiometer assembly can be formed in a molding operation used to form the body of the model or toy. Most especially, it relates to such a potentiometer which can be assembled easily by hand without the use of special tools.

2. Description of the Prior Art

Commercially available wire resistive element potentiometers come in a wide variety of forms, both as linear and rotary potentiometers. They are typically mass produced by electrical component manufacturers and sold as packaged units to manufacturers and others for incorporation into various electrical and electronic equipment.

A large number of models and toys are fabricated from plastic materials, such as polystyrene, in molding operations. Rather than incorporating assembled potentiometers obtained from components manufacturers into models and toys including electrical or electronic circuits used to produce light, sound and similar effects, in the models and toys, it would be desirable to form at least the major portions of a potentiometer assembly by use of the same molding processes used to form the body of the model or toy and have the modeler assemble the potentiometer in the course of completing the model, or assemble it as part of the assembly of a toy incorporating the potentiometer.

There have been some attempts in the art to provide a potentiometer assembly integrally with structural members of a model or toy. However, those approaches typically involve melting a portion of a structural member of the model or toy, and such assemblies have proven to be less reliable than commercially available assembled potentiometers now obtained from component suppliers.

SUMMARY OF THE INVENTION

Accordingly, it is an object of this invention to provide a potentiometer for use in a model or toy which can be assembled by hand without the use of special tools.

It is another object of the invention to provide a potentiometer assembly for use in a model or toy in which at least major portions of the assembly can be formed in a molding operation used to form a body of the model or toy.

It is a further object of the invention to provide such a potentiometer having a reliability comparable to that of commercially available assembled potentiometers.

The attainment of these and related objects is achieved through use of the novel potentiometer herein disclosed. This potentiometer is especially adapted for use in a model or toy and includes a pair of insulating standoffs integrally formed with the body of the model or toy. An insulated trough extends between these standoffs. A resistive element, such as a nichrome wire, is wound around an insulating core and disposed in the trough. A resilient contact element is slidably mounted in engagement with the resistive element. Means extends through the body of the model or toy for sliding the resilient contact element along the resistive element.

Preferably, a contact wire in electrical contact with an end of the resistive element is fastened to at least one of the standoffs through use of a screw or other suitable fastening means and a wire eyelet terminal or washer.

The standoffs are preferably formed in the same molding operation which produces the body of the model or toy. The sliding means may also be formed as a separate part in the molding operation. The portions of the potentiometer assembly not formed in the molding operations are easily assembled with the elements so formed to complete the potentiometer. The potentiometer is easily assembled by a hobbyist in the case of a model incorporating it, or by the manufacturer in the case of a finished toy incorporating it.

The attainment of the foregoing and related objects, advantages and features of the invention will be readily apparent after review of the following more detailed description of the invention, taken together with the drawings, in which:

DETAILED DESCRIPTION OF THE INVENTION

Figure 1:
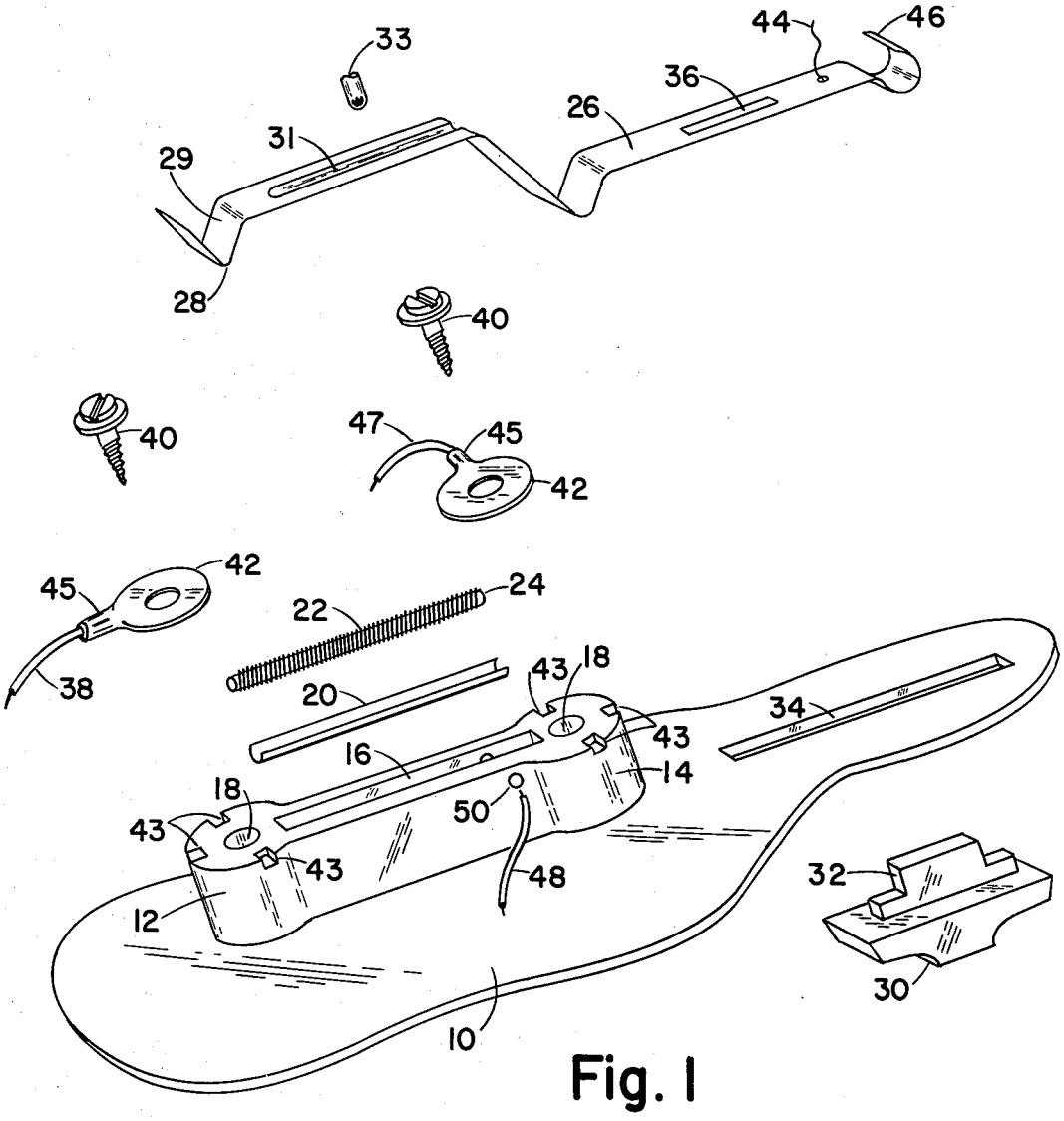
FIG. 1 is an exploded perspective view of a potentiometer in accordance with the invention.
Figure 2:
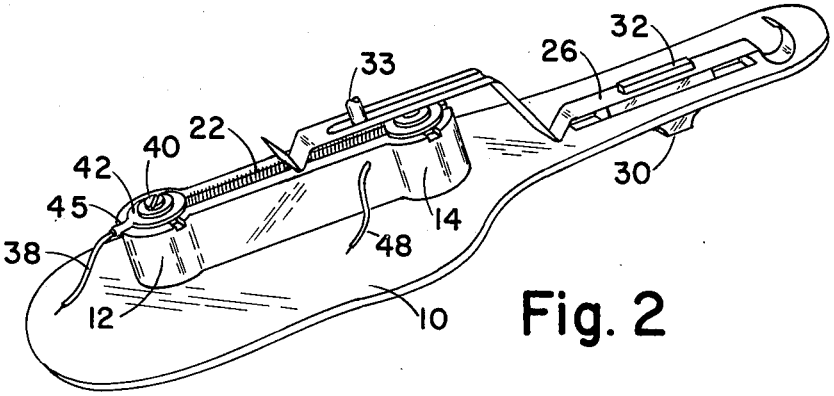
FIG. 2 is a perspective view of the assembled potentiometer.

Turning now to the drawings, there is shown a portion 10 of the planar body wall of a model or toy, formed of polystyrene or other suitable plastic in a molding operation. First and second standoffs 12 and 14 are formed integrally with the body 10 of the model or toy during the mold operation. The standoffs 12 and 14 have a slot 16 extending between them and each has an aperture 18 extending inward from their upper surfaces. A piece of rigid, insulating paper 20, known in the art as fish paper, in a channel shape defining a trough, is inserted in the slot 16. Alternatively, a polystyrene channel-shaped member could be employed for this purpose. A nickel-chromium resistive wire 22 is wound around a solid, for example a high temperature resistant plastic or anodized aluminum, core 24, which is then inserted in the trough defined by member 20. A resilient spring contact or flexible pickup 26 is slidably mounted with its end 28 in engagement with the nichrome resistive element 22. Contact 26 is bent in a shallow U-shaped configuration in the portion 29 to allow the contact to clear right-hand screw 40. Groove 31 on contact 26 cooperates with a projection 33 to assure constant contact between contact 26 and resistive wire 22. A molded polystyrene button 30 has a projection 32 which extends through a slot 34 in the body 10 of the model or toy. The projection 32 forms a friction fit through an aperture 36 in the spring contact 26. A contact wire 38 is fastened to standoff 12 by means of a self tapping screw 40 and wire eyelet 42 with the eyelet 42 serving to establish electrical contact between the wire 38 and the resistive element 22. Slots 43 serve to lock neck 45 of the eyelets 42 in place when screws 40 are tightened. A second contact wire 44 is fastened to the end of 46 of the spring contact 26. If desired, a third contact wire 47 can be attached to the other end of resistive element 22 at standoff 14 in the same manner as contact wire 38, so that one circuit path is completed through the resistive element 22 with the spring contact 26 serving as a pick-off point for a second circuit path. An alternative connection technique is shown with a fourth contact wire 48 extending into insert hole 50, formed transversely through slot 16.

In operation, contact wires 38, 44 and 47 are connected to suitable circuit elements to form a complete circuit. The potential or current at or flowing through the wire 44 at the point it engages the contact 26 is adjusted by moving the spring contact 26 to the right or left, through use of the slidable knob 30. Movement toward the left increases the potential or current, and movement toward the right decreases them. It should be noted that the screws 40, eyelets 42, fish paper 20 and core 24 all serve as heat sinks for the heat generated by resistive wire 22.

This potentiometer can easily be assembled by hand without the use of special tools. In practice, if the parts of the potentiometer are supplied as part of a model kit, the resistance wire 22 being supplied to the consumer already wound on insulating core 24.

It should now be apparent to those skilled in the art that a linear potentiometer of simplified construction suitable for use in models and toys and capable of achieving the stated objects of the invention has been provided. Major portions of the potentiometer assembly can be formed in a molding operation used to form the body of a model or toy incorporating the potentiometer. The construction of the potentiometer gives it a reliability comparable to that of commercially available assembled potentiometers obtained from electrical component suppliers.

It should be apparent to the art skilled that various changes in forms and details of the invention as disclosed may be made. It is intended that such changes be included within the spirit and scope of the claims appended hereto.

What is claimed is:

1. A potentiometer for incorporation in the planar body wall of models and toys, which comprises:

(a) a pair of spaced insulating standoffs integrally formed with and upstanding from one side of the planar body wall;

(b) an insulated slot integrally formed with the planar body wall and extending between said standoffs;

(c) a resistive element wound around an insulating core in and disposed coextensively of said slot;

(d) a second slot through the planar body wall and extending in alignment with and away from said spaced insulating standoffs;

(e) a resilient contact element slidably mounted on said one side of the planar body wall and over said second slot therethrough and having an extending portion in spaced relation to and in sliding contact engagement with said resistive element; and (f) means extending through said second slot in the planar body wall for engaging and sliding said resilient contact element relative to said resistive element.

2. The potentiometer of claim 1 additionally comprising at least one means for fastening a contact wire in electrical contact with said resistive element at at least one of said standoffs.

3. The potentiometer of claim 1 in which an insulating paper of rigid channel shape is inserted in the slot and defining a trough extending between said standoffs to receive said resistive element.

4. A potentiometer for incorporation in the body of models and toys, which comprises:

(a) a pair of spaced insulating standoffs and a slot extending therebetween integrally formed with the body;

(b) an insulating paper of rigid channel-shape inserted in the slot and defining a trough extending between said standoffs;

(c) a resistive element wound around an insulating core in and disposed coextensively of said trough;

(d) a resilient contact element slidably mounted on the body in spaced relation to and in engagement with said resistive element; and (e) means extending through the body for sliding said resilient contact element along said resistive element.

5. A potentiometer for incorporation in the body of models and toys, which comprises:

(a) a pair of spaced insulating standoffs integrally formed with the body;

(b) an insulated slot integrally formed with the body and extending between said standoffs;

(c) a resistive element wound around an insulating core in and disposed coextensively of said slot;

(d) a resilient contact element slidably mounted on the body in spaced relation to and in engagement with said resistive element; and (e) sliding means extending through a slot in the body and fitted into an aperture in said resilient contact element to slide the same along said resistive element.

6. A potentiometer for incorporation in the body of models and toys, which comprises:

(a) a pair of spaced insulating standoffs integrally formed with the body;

(b) an insulated slot integrally formed with the body and extending between said standoffs;

(c) a resistive element wound around an insulating core in and disposed coextensively of said slot;

(d) a resilient contact element slidably mounted on the body in spaced relation to and in engagement with said resistive element;

(e) means extending through the body for sliding said resilient contact element along said resistive element; and (f) a contact wire insertion hole extending transversely of said slot in the body so that said resistive element serves to clamp a contact wire inserted in said hole.

7. The potentiometer of claim 1, wherein a projection cooperates with a groove in the extending portion of the resilient contact element to slide thereagainst and assure contact engagement with the resistive element.

* * * * *